US006720510B2

(12) United States Patent
Passow

(10) Patent No.: US 6,720,510 B2
(45) **Date of Patent: *Apr. 13, 2004**

(54) PUSHER ASSEMBLY AND METHOD OF ASSEMBLING A PUSHER ASSEMBLY

(75) Inventor: Christian H. Passow, Ann Arbor, MI (US)

(73) Assignee: Siemens Energy & Automation, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/961,161

(22) Filed: Sep. 21, 2001

(65) Prior Publication Data

US 2003/0057064 A1 Mar. 27, 2003

(51) Int. Cl.[7] ..... H01H 1/20
(52) U.S. Cl. ..... 200/243; 200/281
(58) Field of Search ..... 200/243, 245–7, 200/250, 280–1, 447, 443

(56) References Cited

U.S. PATENT DOCUMENTS 4,477,703 A * 10/1984 Reguant Soler ..... 200/243 X
4,634,819 A * 1/1987 Ikeda ..... 200/243 X

* cited by examiner

*Primary Examiner*—Renee Luebke

(57) ABSTRACT

The present invention is related to a pusher assembly (105) for use with an operator. According to one aspect of the present invention, a pusher assembly generally comprises a body portion (208); first window (216) formed in the body portion; second window (218) formed in the body portion adjacent to the first window, the second window being wider than the first window. According to another aspect of the present invention, a method for assembling a pusher assembly comprises the steps of inserting (602) a movable contact into a first position in a first window; moving (608) the movable contact to a second window; and rotating (610) the movable contact to a second position within the second window.

19 Claims, 5 Drawing Sheets

PUSHER ASSEMBLY AND METHOD OF ASSEMBLING A PUSHER ASSEMBLY

CROSS-REFERENCE TO RELATED PATENT APPLICATIONS

The present U.S. patent application having at least one common inventor as

- U.S. patent application Ser. No.09/961,155 entitled "System and Method for Auxiliary Contact Assembly", and
- U.S. patent application Ser. No.09/961,159 entitled "System and Method for Auxiliary Contact Assembly and Snap Mounting", and
- U.S. patent application Ser. No.09/961,162 entitled "System and Method for Mounting a Moveable Contact in a Contact Block", and
- U.S. patent application Ser. No. 09/961,156 entitled "System and Method for Mounting a Moveable Contact in a Contact Block", and
- U.S. patent application Ser. No. 09/961,158 entitled "Contact Block Assembly and Method of Assembling a Contact Block Assembly", and
- U.S. patent application Ser. No.09/961,160 entitled "Movable Contact and a Method of Assembling a Pusher Assembly having a Movable Contact", which are filed with the U.S. Patent and Trademark Office concurrently on Sep. 21, 2001, the entirety of each being incorporated herein by reference.

FIELD OF THE INVENTION

The present invention relates to a pusher used in a contact block, and more particularly to a pusher assembly for receiving a movable contact and a method of assembling a pusher assembly.

BACKGROUND OF THE INVENTION

Contact block assemblies are often assembled by hand, and often have a number of springs which make the assembly difficult. In particular, when assembling components of a conventional contact block assembly, it may be necessary for an assembler to compress a spring in order to insert another component of the assembly. In such situations, it is often common that the spring becomes dislodged, and in many cases may becomes lost. More importantly, the difficulty in assembling the contact block may cause additional fatigue on a worker and an increase in assembly errors.

Such problems are particularly true of pusher assemblies, which often have smaller springs that are more difficult to manipulate with the human hand. In particular, inserting a small spring into a pusher by compressing the spring can be difficult. Further, when a pusher assembly is assembled in a contact block, it is beneficial if the components of the pusher assembly are secured within the pusher assembly. That is, the pusher assembly could be picked up and placed in the contact block housing without any fear that components of the pusher assembly would become dislodged. Accordingly, there is a need for a pusher assembly which is easy to assemble and will stay intact prior to assembly into a contact block.

SUMMARY OF THE INVENTION

The present invention is related to a pusher assembly for use in a contact block. According to one aspect of the present invention, a pusher assembly generally comprises a body portion, a first window formed in the body portion, and a second window formed adjacent to the first window, wherein the second window is wider than the first window.

According to another aspect of the present invention, a method for assembling a pusher assembly comprises the steps of inserting a movable contact into a first position in a first window; moving the movable contact to a second window; and rotating the movable contact to a second position within the second window.

It is an object of the invention to provide an improved pusher assembly having a movable contact and a spring.

It is a further object of the invention to provide a contact block assembly having an improved pusher assembly.

It is a further object of the invention to provide an improved method for assembling a pusher assembly.

Other objects and advantages will become apparent from the following specification taken in connection with the accompanying drawings.

DESCRIPTION OF THE PREFERRED EMBODIMENTS

Figure 1:
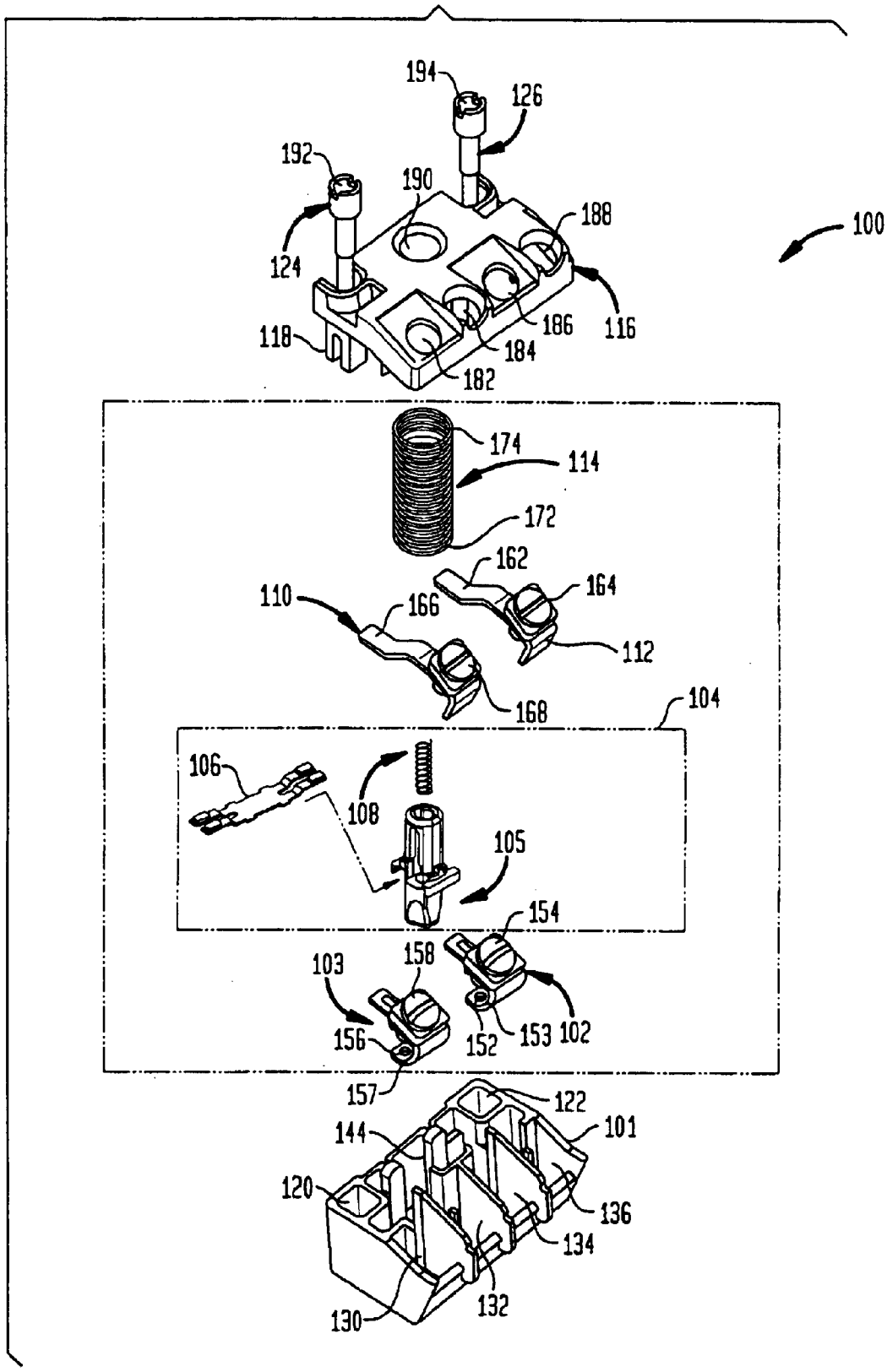
FIG. 1 is an exploded view of a contact block assembly according to the present invention.

Turning first to FIG. 1, an exploded view of a contact block assembly 100 according to the present invention is shown. The contact block assembly 100 comprises a lower housing 101 for receiving stationary contacts 102 and 103, and a pusher assembly 104. The pusher assembly 104 includes a pusher 105, a movable contact 106 and a contact spring 108. The contact block assembly 100 further includes stationary contacts 110 and 112. Although four stationary contacts are shown for a two pole contact block assembly, two stationary contacts could be employed in a one pole contact block assembly, as is well known in the art. Also, the orientation or shape of the stationary contacts could vary, depending upon whether the contact block assembly 100 is configured to be in an "normally open" or "normally closed" arrangement, as is well known in the art. The contact block assembly further includes a return spring 114 and a cover 116. When the contact block is assembled, a snap 118 is coupled to a complimentary receiving portion 120 to secure the cover 116 to the lower housing 101. A similar snap (not visible) is coupled to a second receiving portion 122. Finally, mounting screws 124 and 126 enable stacking of contact block assemblies, or the attachment of an operator, as is well known in the art.

The lower housing 101 further includes recesses 130, 132, 134, and 136 for receiving the stationary contacts 102, 103, 110, and 112. The lower housing 101 further includes a recess 144 for receiving the pusher assembly 104. The stationary contact 102 further includes a contact portion 152 and a contact screw 154. A contact surface 153 is associated with the contact portion 152. Similarly, a contact portion 156, a contact surface 157 and a contact screw 158 are shown on the stationary contact 103. The stationary contact 112 includes a contact 162 and a contact screw 164, while the stationary contact 110 includes a contact 166 and a contact screw 168. Contact surfaces (not visible) are formed on the underside of contacts 162 and 166. The return spring 114 extends from a first end 172 to a second end 174. Finally, cover 116 includes openings 182, 184, 186, and 188 for enabling access to contact screws 154, 158, 164, and 168. Also, an opening 190 and threaded portions 192 and 194 enable the coupling of multiple contact block assemblies, as is well known in the art.

Figure 2:
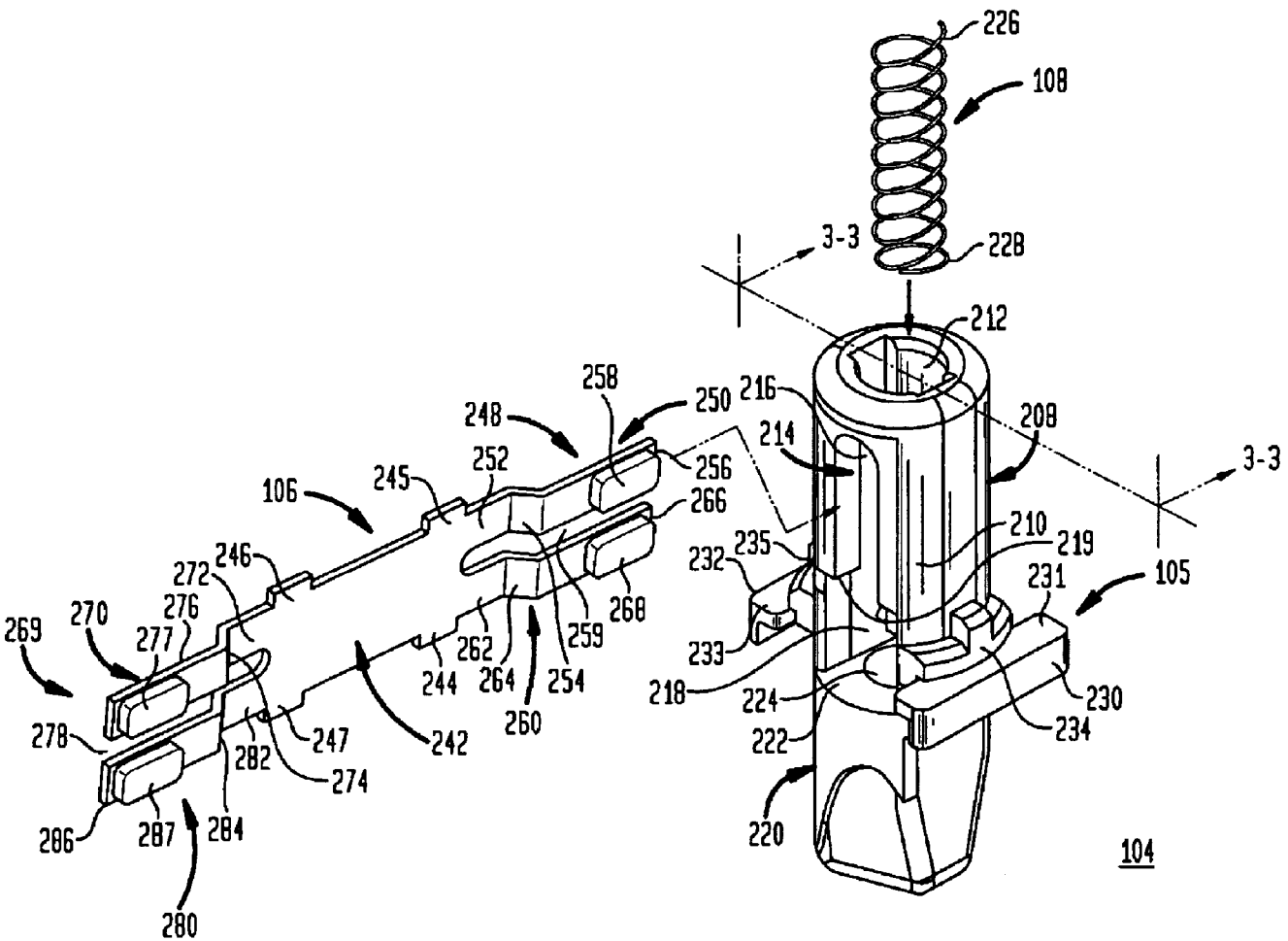
FIG. 2 is an exploded view of a pusher assembly according to the present invention.

Turning now to FIG. 2, an exploded view of the pusher assembly 104 is shown. The pusher 105 comprises a body portion 208 which includes an upper portion 210 having a recess 212 formed at a first end of the pusher 105, as shown at the top in the orientation of FIG. 2. The recess 212 enables an easy loading of the contact spring (i.e. the contact spring does not need to be compressed to be loaded into the pusher 105, but merely dropped into the recess 212). A window 214 is also formed in a side of the pusher 105, and extends through the back side (not visible). The window 214 includes an entry window portion 216 and a main window portion 218. The entry window portion 216 is long enough and wide enough to receive the movable contact 106 in the orientation shown in FIG. 2, as will be described in more detail in reference to the remaining figures. Similarly, the main window portion 218 is long enough and wide enough to allow the rotation of the movable contact 106 to a second orientation, such as the orientation shown in FIG. 5. The positioning of the entry window portion 216 and the main window portion 218 adjacent to each other creates shoulder portions 219 as shown in FIG. 2. The assembly of the pusher assembly 104 will be described in more detail in reference to FIGS. 4 and 5.

The pusher assembly 105 further includes a lower body portion 220 having a ledge 222 and a lower recess 224. The spring 108, which extends from a first end 226 to a second end 228, is generally inserted through the recess 212 into the lower recess 224. Finally, pusher 105 includes a first mounting arm 230 having a ledge 231 and a second mounting arm 232 having a ledge 233. The mounting arms 230 and 232 further include guides 234 and 235 respectively for receiving and properly positioning the return spring 114.

The mounting arms 230 and 232 may be of a different size and/or shape to prevent an inadvertent error in inserting the pusher assembly into a contact block housing. In particular, by forming the first mounting arm 230 and the second mounting arm 232 of different shapes, the incorrect insertion of the pusher assembly into a contact block assembly could be avoided.

The movable contact 106 comprises a body portion 242 which is substantially flat. The flat body portion of the movable contact further enables an easy assembly of the pusher. As will be described in detail in reference to FIGS. 4 and 5, the movable contact 106 is easily moved into the main window portion 218 because the contact spring 108 is retained in the lower recess 224. Any compression of the contact spring 108 into the recess will not cause the contact spring 108 to become dislodged from the lower recess 224. The body portion being substantially flat on both sides also enables mounting for both normally open and normally closed configurations.

The movable contact also has a first flange 244 extending from a first side and a second flange 245 extending from a second side. The movable contact 106 includes a second set of flanges including a third flange 246 extending from the first side and a fourth flange 247 extending from the second side. Flanges 244 through 247 are generally included to retain the movable contact 106 within the pusher 105. Although four flanges are shown, two flanges could be used to retain the movable contact 106 within the pusher 105. While the flanges as shown are symmetric, the number, shape and/or orientation of flanges could be chosen to prevent the improper insertion of the movable contact 106 into the pusher 105.

The movable contact 106 further includes a first contact element 248 extending from a first end of the body portion 242. The first contact element 248 includes a first finger 250 having a fulcrum portion 252, an inclined portion 254, and a contact portion 256. The contact portion includes a contact surface 258. The contact surface could be composed of any conducted material, such as silver, applied by plating, bonding, soldering or some other suitable method. A slot 259 separates the first contact finger 250 from a second contact finger 260. The second contact finger 260 comprises a fulcrum portion 262, an inclined portion 264, and a contact portion 266, also having a contact surface 268.

A second contact element 269 extending from a second end of the movable contact includes a third finger 270 having a fulcrum portion 272, an inclined portion 274, and a contact portion 276 having a contact surface 277. A slot 278 separates the third contact finger 270 from a fourth contact finger 280. Similarly, the fourth contact finger includes a fulcrum portion 282, an inclined portion 284, and a contact portion 286 having a contact surface 287. The inclined portions provide an offset which allows for an easy test to confirm correct installation, as will be described in reference to FIGS. 6 and 7.

Figure 3:
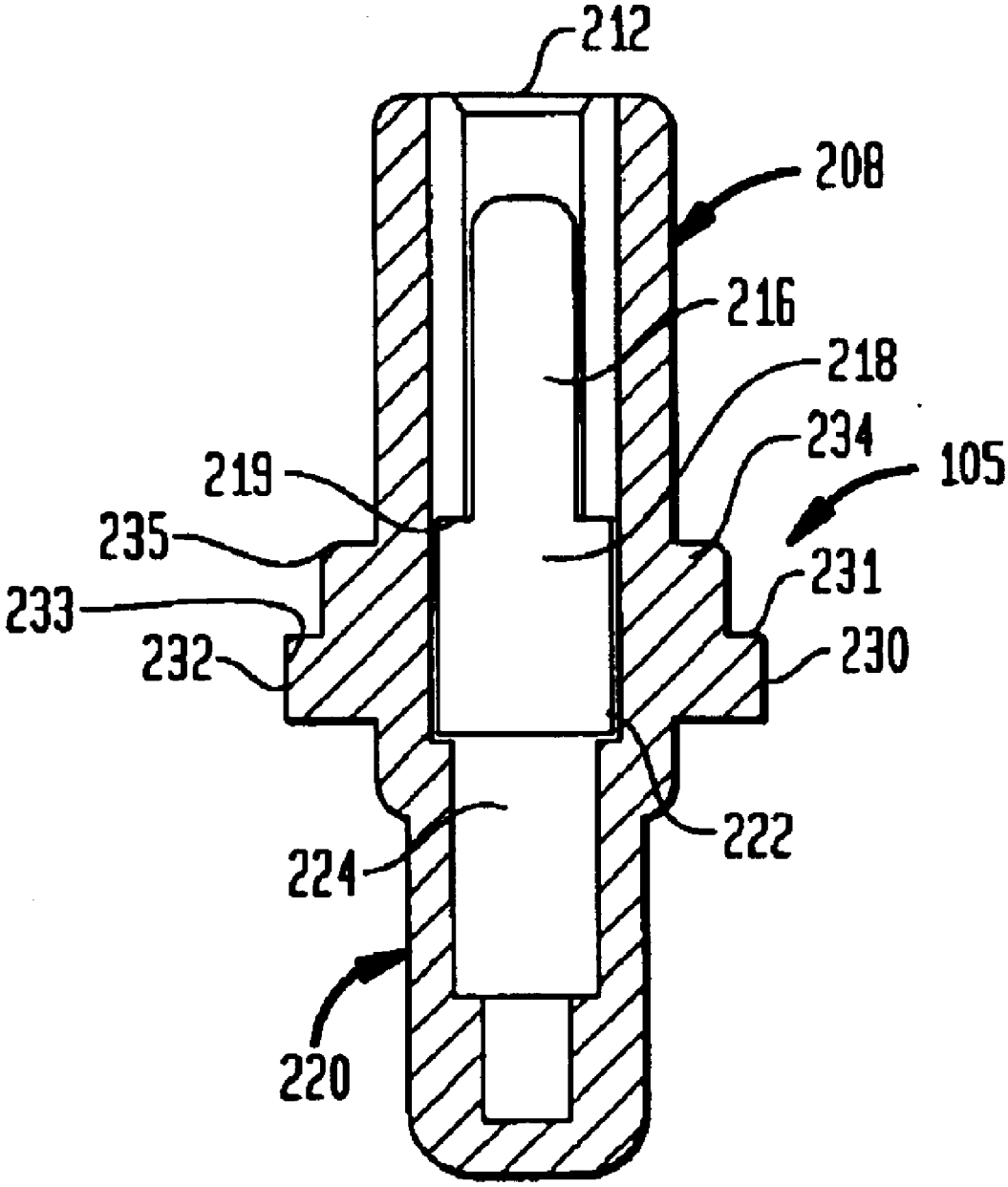
FIG. 3 is a cross-sectional view of the pusher of FIG. 2 taken at lines 3—3.

Turning now to FIG. 3, a cross-section of the pusher 105 is shown. As is more clear in this cross-section, the entry window portion 216 and the main window portion 218, as shown, extend through the upper body portion 210. Also shown is recess 212 extending through the top of the upper body portion 219 to recess 224 in the lower body portion 220 for receiving the contact spring 108.

Figure 4:
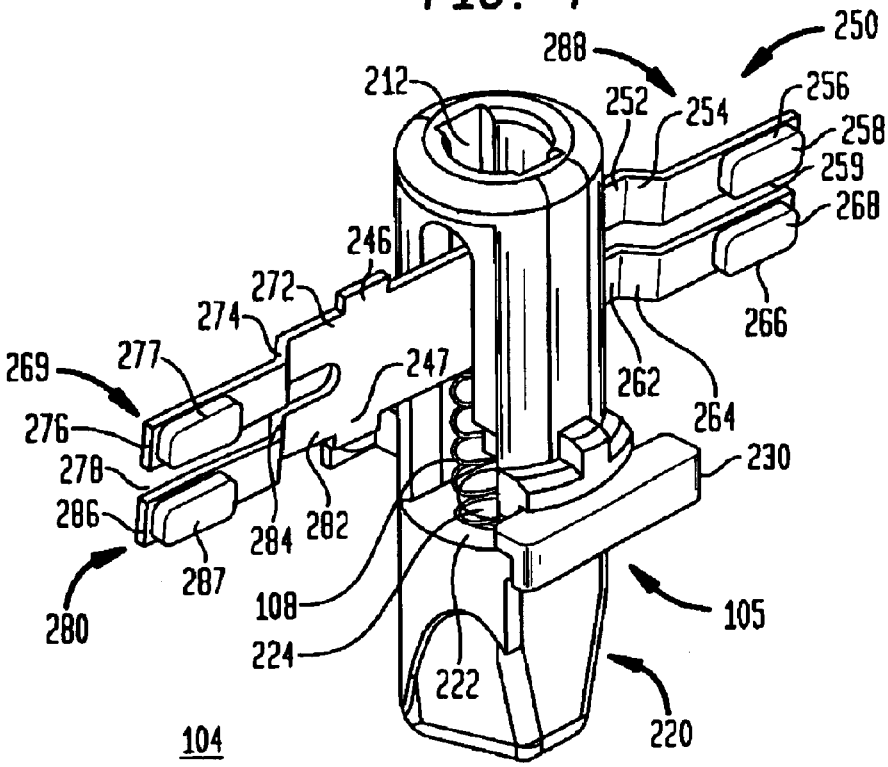
FIG. 4 is a perspective view of the pusher assembly during a first stage of assembly according to the present invention.
Figure 5:
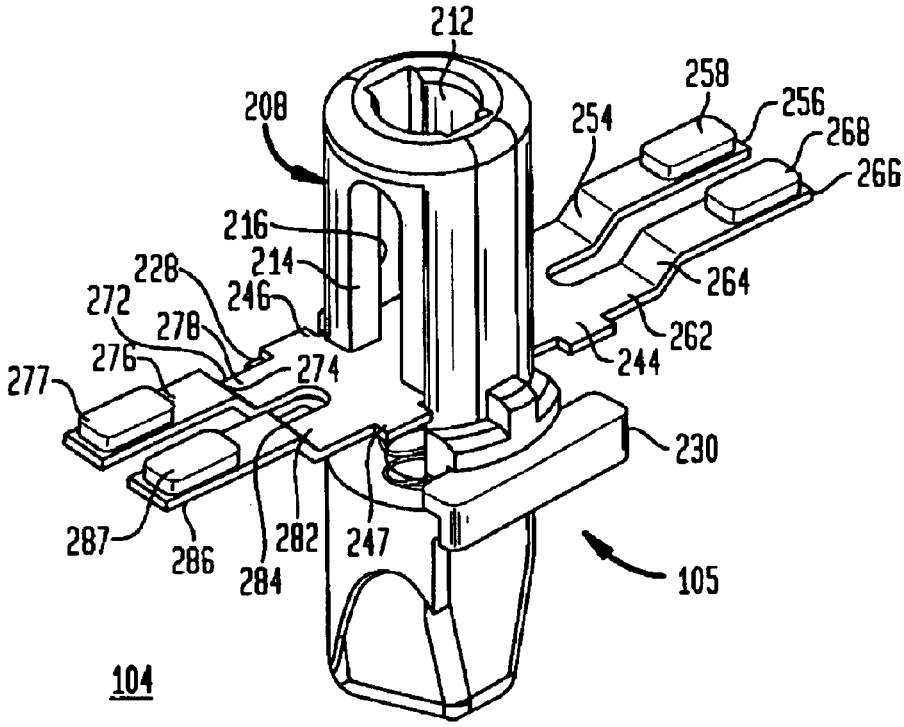
FIG. 5 is a perspective view of the pusher assembly at a second stage of assembly according to the present invention.

Turning now to FIGS. 4 and 5, the method of assembly of the pusher assembly 104 is shown. In particular, the movable contact 106 is inserted into the upper window portion 216 in the vertical position as shown in FIG. 4. The movable contact is then moved downward, compressing the contact spring 108. When the side of the movable contact 106 having flanges 245 and 246 clears the lower end of the entry window portion 216 at the shoulder portions 219, the movable contact 106 is then rotated into a horizontal position as shown in FIG. 5. The force of the contact spring 108 urges the movable contact 106 to a resting position against the shoulders 219. That is, the body portion makes contact with the shoulders 219. As also can be see in FIG. 5, the flanges 246 and 247 extend beyond the main window portion 218 preventing any lateral movement of the movable contact 106 within the main window portion 218. The flanges 244 and 245 also prevent any lateral movement of the movable contact 106 in the opposite direction.

The assembled pusher assembly 104 shown in FIG. 5 provides considerable advantage in the assembly of a contact block assembly shown in FIG. 1. In particular, once the pusher assembly 105 is assembled, an assembler of the contact block assembly 100 need not worry that the movable contact 106 or the contact spring 108 will become dislodged during assembly. Similarly, the pusher assembly 104 could be assembled prior to any assembly of the contact block assembly 100, providing flexibility in assembling the contact block assembly 100. While the movable contact 106 was rotated to the horizontal position shown in FIG. 5, the movable contact could be rotated in the other direction so that the movable contact 106 is in the opposite orientation, depending upon the design of the contract block assembly. Although only a single movable contact block assembly is shown, it will be understood that two movable contacts, placed back-to-back, may be inserted into the pusher. Finally, while the movable contact 106 is shown resting against the shoulders 219, the movable contact may not be resting against the shoulders when the contact block assembly 100 is assembled or operated.

Figure 6:
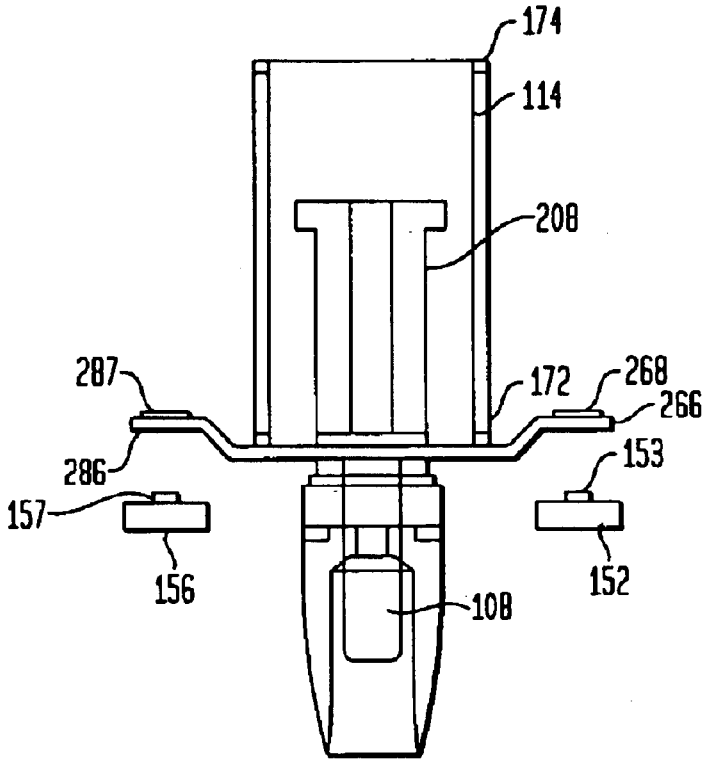
FIG. 6 is a perspective view of the pusher assembly with an incorrectly installed movable contact according to the present invention.
Figure 7:
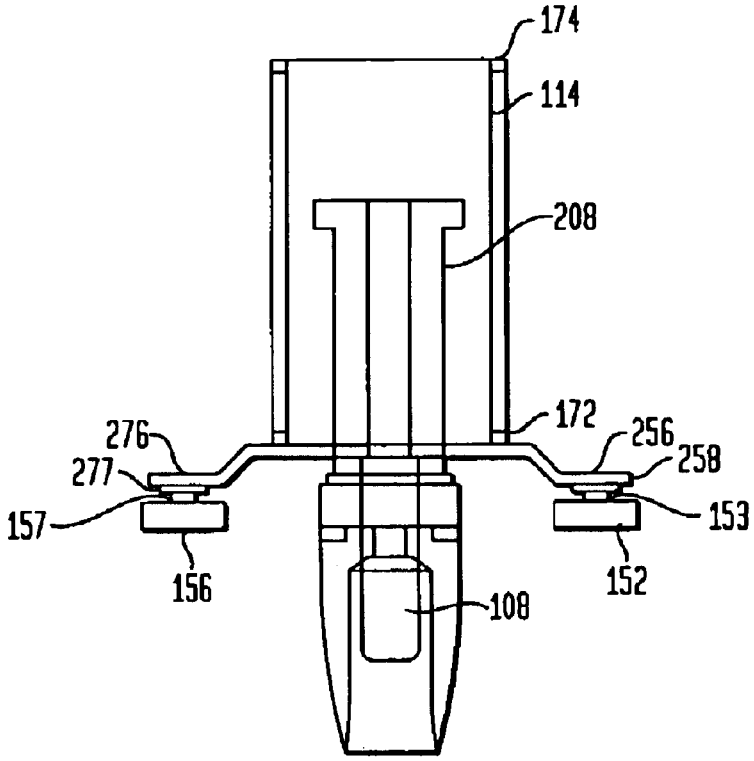
FIG. 7 is a perspective view of the pusher assembly with a correctly installed movable contact according to the present invention.

Turning now to FIGS. 6 and 7, a perspective view of the assembled components 115 shows the benefit of the movable contact according to the present invention. As shown incorrectly inserted in FIG. 6, the movable contact fails to make a contact with any stationary contact. During a simple test, it would be easy to determine whether the movable contact is incorrectly inserted. When correctly inserted as shown in FIG. 7, the movable contact clearly makes contact with the stationary contacts. Accordingly, the movable contact of the present invention provides a significant advantage during the assembly process of a pusher assembly by allowing detection of an incorrectly inserted movable contact.

It can therefore be appreciated that a new and novel system and method for a pusher assembly has been described. It will be appreciated by those skilled in the that, given the teaching herein, numerous alternatives and equivalent will be seen to exist which incorporate the disclosed invention. As a result, the invention is not to be limited by the foregoing exemplary embodiments, but only by the following claims.

We claim:

1. A pusher assembly for use in a contact block assembly, said pusher assembly comprising:

a body portion having an open top end defining an interior recess;

a first window formed in said body portion;

a second window formed in said body portion adjacent to said first window, said second window being larger than said first window to define a shoulder;

a spring received in the recess through the top end; and a movable contact positioned within said second window captured between the spring and the shoulder.

2. A pusher assembly for use in a contact block assembly, said pusher assembly comprising:

a body portion;

a first window formed in said body portion;

a second window formed in said body portion adjacent to said first window, said second window being larger than said first window; and a movable contact positioned within said second window, wherein said first window and said second window are formed in a first portion of said body portion and a recess is formed in said first portion of said body portion, wherein said recess formed in said first portion of said body portion further extends to a second portion of said body portion.

3. The pusher assembly of claim 2 further comprising a spring positioned within said recess.

4. A pusher assembly for use in a contact block assembly, said pusher assembly comprising:

a body portion;

a first window formed in said body portion;

a second window formed in said body portion adjacent to said first window, said second window being larger than said first window; and a movable contact positioned within said second window, wherein said first window and said second window are formed in a first portion of said body portion and a recess is formed in said first portion of said body portion, and a spring is positioned within said recess and further comprising shoulders between said first window and said second window.

5. The pusher assembly of claim 4 wherein said spring movably retains said movable contact within said second window.

6. The pusher assembly of claim 5 wherein said spring movably retains said movable contact against said shoulders of said second window.

7. A pusher assembly for use in a contact block assembly, said pusher assembly comprising:

a body portion extending from a first end to a second end;

a first window extending through sidewalls in said body portion for receiving a movable contact in a first position;

a second window extending through sidewalls in said body portion, said second window being larger than said first window to retain said movable contact when moved to a second positions, wherein said first window and said second window are formed in a first portion of said body portion;

a recess formed through said first end of said body portion, said first window and said second window for receiving a spring, and wherein said recess further extends to a second portion of said body portion; and a movable contact positioned within said second window.

8. The pusher assembly of claim 7 further comprising shoulders between said first window and said second window.

9. The pusher assembly of claim 8 wherein said spring movably retains said movable contact against said shoulders when said movable contact is positioned in said second window.

10. The pusher assembly of claim 7 wherein said movable contact can be inserted in a desired orientation, said desired orientation being detectable.

11. A pusher assembly for use in a contact block assembly, said pusher assembly comprising:

a body portion extending from a first end to a second end and having a first portion and a second portion;

a first window formed through sidewalls in said first portion of said body portion;

a second window formed through sidewalls in said first portion of said body portion, said second window being larger than said first window and being formed adjacent to said first window to form shoulder portions between said first window and said second window;

a recess formed through said first end of said body portion, said first window and said second window and said second portion of said body portion;

a spring positioned within said recess; and a movable contact positioned within said second window and movably retained against said shoulders by said spring.

12. The pusher assembly of claim 11 wherein said movable contact can be inserted in a correct orientation and an incorrect orientation, said incorrect orientation being detectable in a test.

13. A method for assembling a pusher assembly, said method comprising the steps of:

inserting a movable contact into a first position in a first window through a pusher;

moving said movable contact to a second window through said pusher; and rotating said movable contact to a second position within said second window.

14. The method of claim 13 herein said step of inserting said movable contact comprises inserting said movable contact in a substantially vertical position through said first window of said pusher assembly.

15. The method of claim 13 wherein said step of rotating said movable contact comprises rotating said movable contact to a substantially horizontal position.

16. The method of claim 13 further comprising a step inserting a contact spring though a recess in said body portion.

17. The method of claim 16 further comprising a step of retaining said movable contact against a shoulder of said second window.

18. The method of claim 13 further comprising a step of inserting said pusher assembly into a contact block.

19. The method of claim 17 further comprising a step of determining if said movable contact is incorrectly inserted in said pusher assembly.

* * * * *